US006305395B1

(12) United States Patent
Oledzki et al.

(10) Patent No.: US 6,305,395 B1
(45) Date of Patent: Oct. 23, 2001

(54) APPARATUS ENABLING DISABLED PERSONS TO WALK

(75) Inventors: Andrzej Oledzki; Bogdan Szymczak, both of Warszawa (PL)

(73) Assignee: Politechnika Warszawska, Warzaa (PL)

( * ) Notice: Subject to any disclaimer, the term of this patent is extended or adjusted under 35 U.S.C. 154(b) by 0 days.

(21) Appl. No.: 09/423,376

(22) PCT Filed: Apr. 30, 1998

(86) PCT No.: PCT/PL98/00019

§ 371 Date: Jan. 4, 2000

§ 102(e) Date: Jan. 4, 2000

(87) PCT Pub. No.: WO98/49991

PCT Pub. Date: Nov. 12, 1998

(30) Foreign Application Priority Data

May 6, 1997 (PL) ..... 319821

(51) Int. Cl.[7] ..... A61H 3/02
(52) U.S. Cl. ..... 135/68
(58) Field of Search ..... 135/65–68, 74

(56) References Cited

U.S. PATENT DOCUMENTS

| | | | | |
|---|---|---|---|---|
| 4,245,659 | * | 1/1981 | Shofner | 135/68 |
| 5,348,035 | * | 9/1994 | Porter | 135/66 |

FOREIGN PATENT DOCUMENTS

| | | | | |
|---|---|---|---|---|
| 2802731 | | 7/1979 | (DE) | A61H/3/00 |
| 9418858 | | 5/1996 | (DE) | A63B/22/20 |
| 1188647 | * | 4/1970 | (GB) | 135/68 |
| 307620 | | 9/1996 | (PL) | A61H/3/00 |

* cited by examiner

*Primary Examiner*—Beth A. Stephan
(74) *Attorney, Agent, or Firm*—Levisohn, Lerner, Berger & Langsam

(57) ABSTRACT

An apparatus enabling disabled persons to walk, comprising a rigid elliptic jacket (1) abutting against and supported by wearer's pelvis, attached to the movement direction change mechanism (2), open in its rear portion and provided with a lock (4), whereas on vertical members of the rectilinear movement mechanism (3) there are mounted cylindrical shank clamps (5), each having open rear portion, and skids (7) rigidly attached to foot supporting platforms (6), constituting lowermost members of the rectilinear movement mechanism; the skids (7) resting on surface of available walkway.

12 Claims, 5 Drawing Sheets

APPARATUS ENABLING DISABLED PERSONS TO WALK

BACKGROUND OF THE INVENTION

1. Field of the Invention

The invention refers to an apparatus enabling disabled persons to walk.

2. Description of the Related Art

The Polish patent application P-307 620 (published as PL 176,092 on Sep. 16, 1996), the teachings of which are incorporated by reference herein, discloses an apparatus assisting disabled persons in walking. This apparatus comprises two mechanisms in the form of articulated rectangles, one of them being a two-dimensional rectangle for rectilinear motion whereas another three-dimensional rectangle is responsible for movement direction changes. This solution provides effective means for stiffening lower limbs of a disabled person involved as well as to perform rotational motion of lower limbs around their natural pivots i.e. hip joints.

The apparatus according to this invention is devoid of such disadvantage.

The apparatus according to this invention comprises a rigid elliptic jacket abutting against and supported by wearer's pelvis, attached to the movement direction change mechanism, open in its rear portion and provided with a lock, whereas on vertical members of the rectilinear movement mechanism there are mounted cylindrical shank clamps, each having open rear portion, and skids rigidly attached to foot supporting platforms, constituting lowermost members of the rectilinear movement mechanism; the skids resting on the ground or floor, as appropriate.

In the apparatus of the invention, the connection between each respective rectilinear walking movement mechanism and the movement direction changing mechanism is on the vertical axis of symmetry of the rectilinear walking movement mechanism.

The direction changing mechanism enables the patient's leg to turn around the vertical axis. Preferably, the direction changing mechanism is formed of members which are pivoted or are articulated together, as this permits good angular change of movement.

BRIEF DESCRIPTION OF THE DRAWINGS.

An embodiment of the apparatus according to invention enabling disabled persons to walk is described below by way of example with reference to the attached drawing wherein the left-hand half of the apparatus, symmetrical to the right-hand one, is shown schematically and in which.

Figure 1:
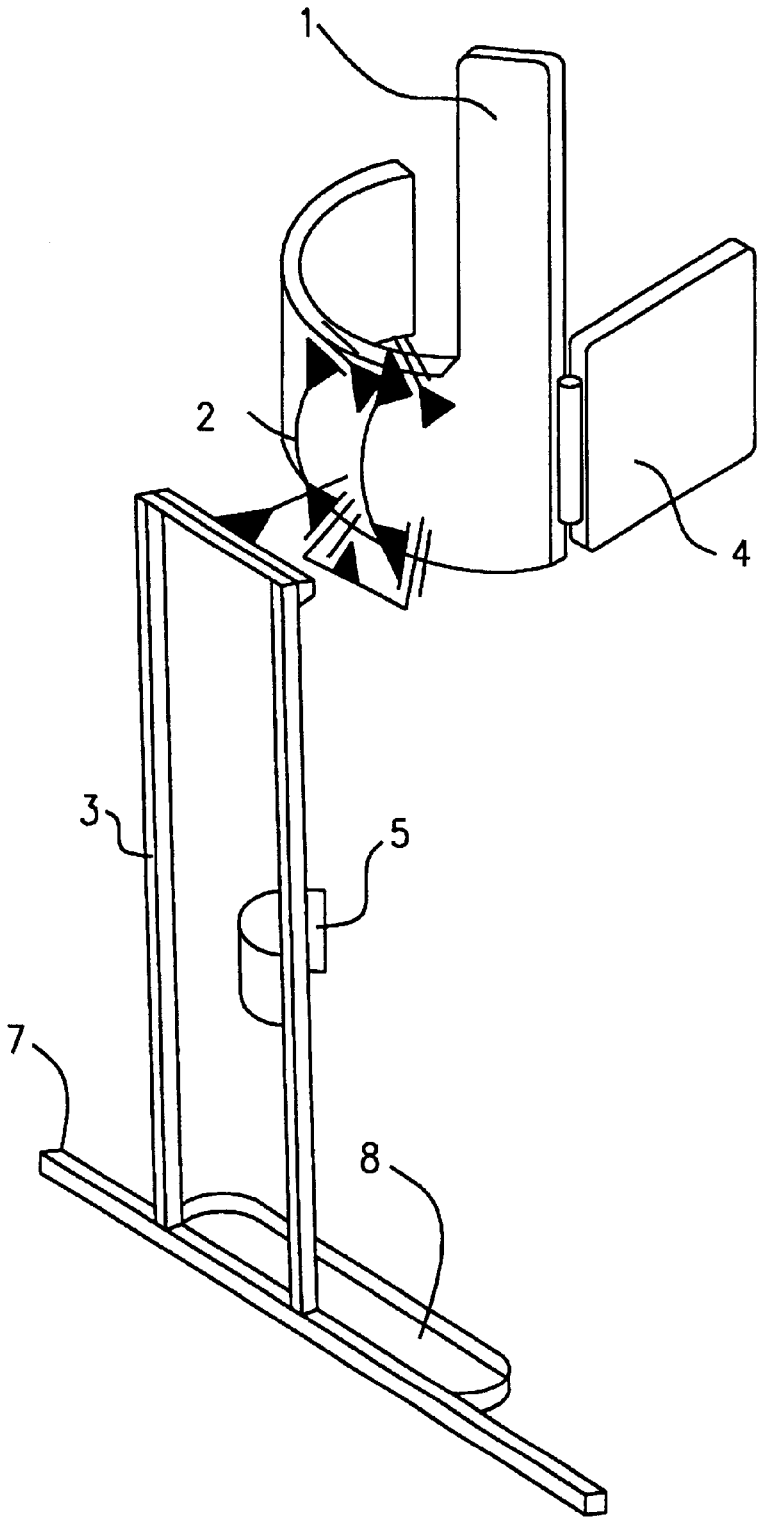
FIG. 1 is a perspective view of the apparatus of the invention.
Figure 1A:
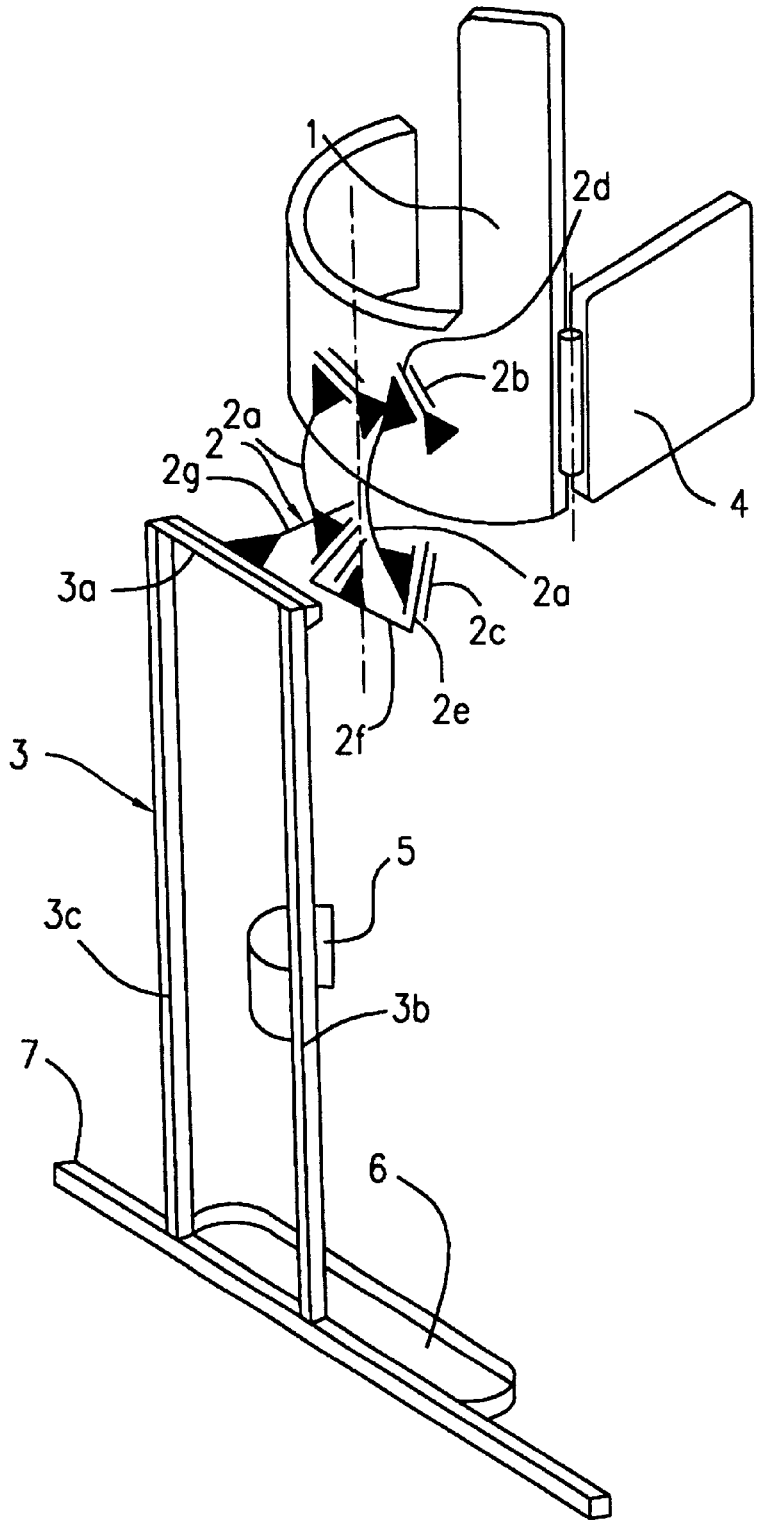
FIG. 1*a* is the same view as that of FIG. 1 but in which the direction change mechanism is shown lower on 1he jacket for clarity.
Figure 2:
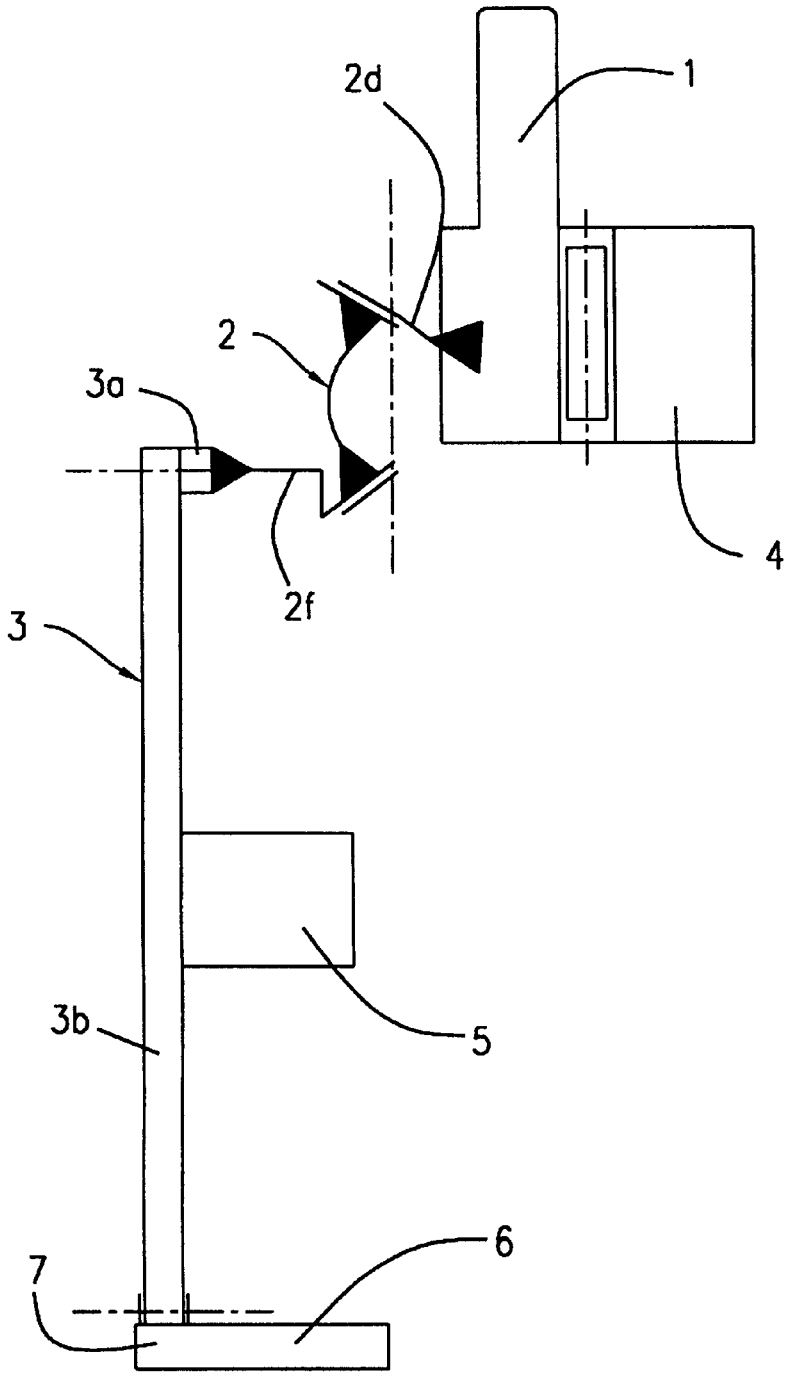
FIG. 2 is a front view of the apparatus.
Figure 3:
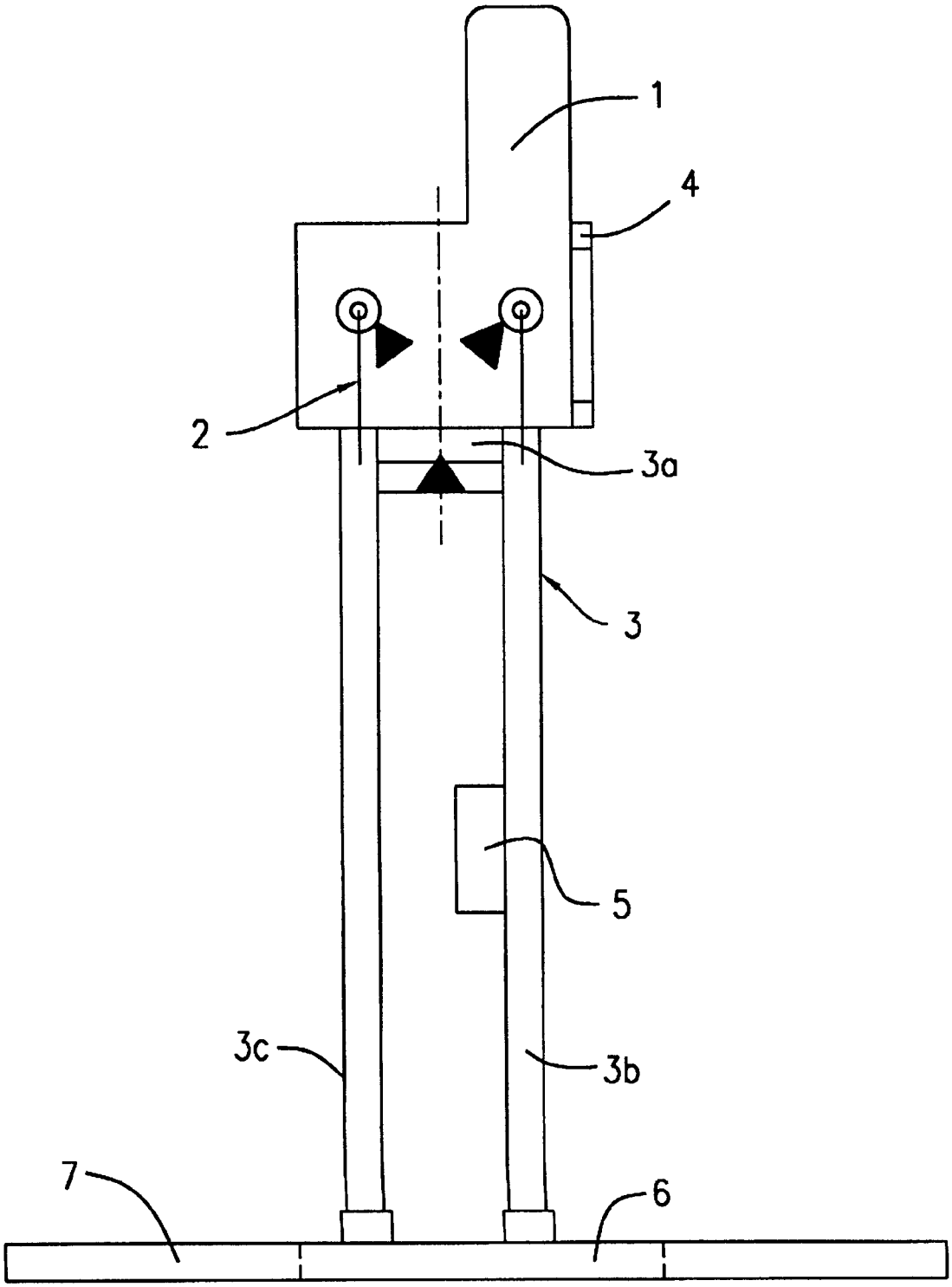
FIG. 3 is a side view of the apparatus.
Figure 4:
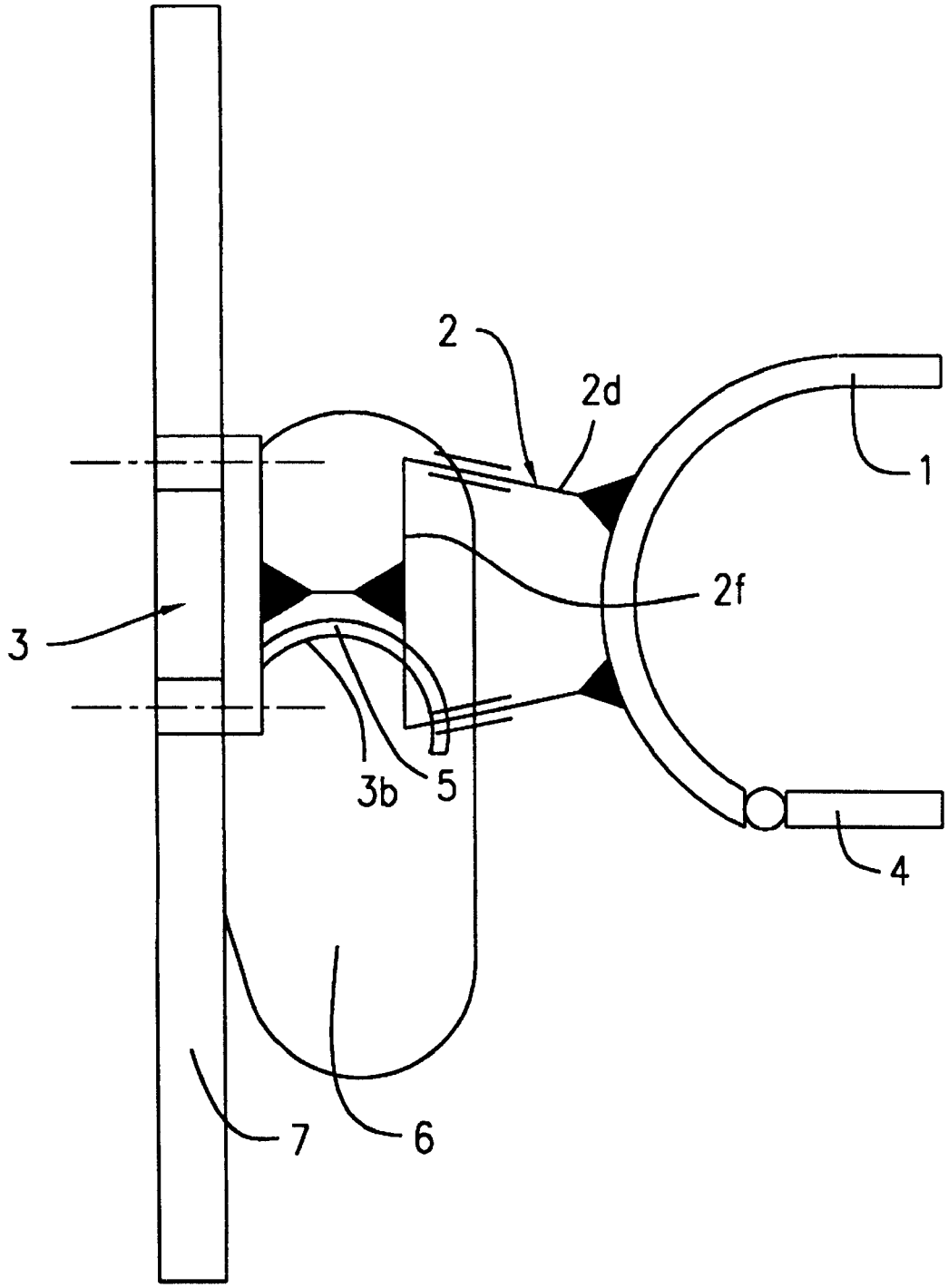
FIG. 4 is a top view of the apparatus.

DETAILED DESCRIPTION OF THE PREFERRED EMBODIMENTS;

The apparatus shown there comprises a pelvis clamp or jacket 1 attached to the movement direction change mechanism 2. The rectilinear movement mechanism 3 is coupled to the direction change mechanism 2. The function of the direction change mechanism 2 is to swivel or move the respective rectilinear movement mechanism 3 about a vertical axis relative to the jacket or pelvis clamp 1. The direction change mechanism 2 is an articulated rectangle in three dimensions, comprising two arcuate members 2*a* each rigidly fixed at each end to respective upper and lower pivots sleeves 2*b*, 2*c*. The upper pivot sleeves 2*b* are pivoted to pivot pins 2*d* rigidly fixed to the jacket 1. The power pivot sleeves 2*c* arc pivoted to pivot pins 2*e* forming part of a fork-shaped member 2*f*. The walking movement mechanism 3 is a two-dimensional articulated rectangle and has a horizontal upper member 3*a* which is rigidly connected to the fork-shaped member 2*f*, and front and rear generally vertical members 3*b*, 3*c* whose upper end portions are pivoted to the upper member 3*a*. The lower end portions of the vertical members 3*b*, 3*c* are pivoted to a skid 7 to which a foot platform 6 is attached. It will be seen that the connection between the fork-shaped member 2*f* of the direction change mechanism 2 is in the middle of the horizontal upper member 3*a* of the walking movement mechanism 3 and hence equidistant the upper end portions of the generally vertical members 3*b*, 3*c* and on the vertical axis of symmetry of the walking movement mechanism 3. The horizontal limb 2*g* of the fork-shaped member 2*f* is equidistant the pivot pins 2*e*.

The jacket 1 is of rearwardly open design so that a disabled person is able to enter the apparatus self-dependently directly from a wheel-chair standing at the back of that apparatus. After entering the apparatus and assuming straight erect positions the patient's trunk becomes immobilised within the jacket 1 by closing the lock 4. On the rear vertical members 3*b* of the rectilinear movement mechanism 3 there are mounted shank clamps 5 preventing articulation of the knee joint while standing. The skids 7 rest on a surface over which a patient wishes to walk. Skids 7 stabilise the apparatus in vertical position and ensure that the patient's feet are being kept always parallel to the walkway surface in each phase of walking.

The apparatus according to present invention prevents occurrence of decubital changes on patient's body normally resulting from seating by enabling disabled persons being bound to their wheel-chairs to change positions from seating to erect one and vice versa always when they are wishing to do so, allowing thereby to avoid prolonged spot pressure exerted at fixed points of patient's body. Furthermore the seating position results in incorrect arrangement of body organs which in turn is conductive of degenerative changes in such body organs.

The apparatus according to present invention allows to load in natural way the osseous system of lower limbs thus preventing decalcification of bones and occurrence of joint ankylosis. By assuming erect position increase in blood pressure is caused which results in better heart action, better blood supply to patient's brain, preventing at the same time occurrence of haemostasis in lower limbs.

By making use of the apparatus of present invention better action of patient's respiratory system is ensured too. A psychological aspect of using the apparatus of present invention is also of great importance as a patient is able e.g. to stand face-to-face against his/her interlocutor and can use any equipment located at normal height.

What is claimed is:

1. An apparatus for enabling a disabled wearer to walk on a walk surface, comprising:

a pelvis clamp in the form of a rigid generally elliptical member for securing to the pelvis zone of the wearer;

two movement direction change mechanisms connected to said pelvis clamp, one on each side thereof; and two mechanisms for rectilinear walking movement, one on each side of said pelvis clamp, each of said rectilinear walking movement mechanisms comprising:

an upper member connected to one of said respective direction change mechanism to thereby form a connection;

two generally vertical members having upper end portions articulatedly connected to said upper member and lower end portions; and a foot support platform articulatedly connected to said lower end portions of said generally vertical members, wherein said movement direction change mechanisms enable said rectilinear walking movement mechanisms to be moved about respective vertical axes with respect to said pelvis clamp to change the direction of walking, said connection between each of said respective rectilinear walking movement mechanisms and said direction change mechanisms being generally equidistant said upper end portions of said generally vertical members.

2. The apparatus of claim 1, wherein said pelvis clamp defines an open rear, said apparatus further comprising:

a locking member for closing said open rear and clamping said pelvis clamp to the wearer's pelvis;

cylindrical leg clamps respectively mounted on at least one of said vertical members of each of said rectilinear walking movement mechanisms, each of said leg clamps defining a rear opening configured to receive one of the wearer's legs.

3. The apparatus of claim 1, further comprising skids rigidly attached to each of said foot supporting platforms, said skids resting on the walk surface.

4. An apparatus for enabling a disabled wearer to walk on a walk surface, the apparatus comprising:

a pelvis clamp in the form of a rigid generally elliptical member for securing to the pelvis zone of the wearer;

two movement direction change mechanisms connected to the pelvis clamp, one on each side thereof, each of said direction change mechanism comprising a support member and a front and a rear articulation; and two rectilinear walking movement mechanisms, one of each side of the pelvis clamp, each of said rectilinear walking movement mechanisms comprising:

an upper member rigidly connected respectively to said support members of said direction change mechanisms;

two generally vertical members having upper end portions articulated to said upper member; and lower end portions articulatedly connected to a foot support platform, wherein said direction change mechanisms enable said rectilinear walking movement mechanisms to be moved about respective vertical axes with respect to said pelvis clamp to change the direction of walking, a mid-way point between said upper end portions of said generally vertical members being generally in the same transverse vertical location as a mid-way point between said front and rear articulations of said direction change mechanisms.

5. The apparatus of claim 4, wherein said pelvis clamp defines an open rear, said apparatus further comprising:

a locking member for closing said open rear and clamping said pelvis clamp to the wearer's pelvis;

leg clamps respectively mounted on at least one of said vertical members of each of said rectilinear walking movement mechanisms, each of said leg clamps defining a rear opening configured to receive one of the wearer's legs.

6. The apparatus of claim 4, further comprising skids rigidly attached to each of said foot supporting platforms, said skids resting on the walk surface.

7. An apparatus for enabling a disabled wearer to walk on a walk surface, comprising:

a pelvis clamp in the form of a rigid generally elliptical member for securing to the pelvis zone of the wearer;

two movement direction change mechanisms connected to said pelvis clamp, one on each side thereof; and two mechanisms for rectilinear walking movement, one on each side of said pelvis clamp, each of said rectilinear walking movement mechanisms comprising:

an upper member connected to one of said respective direction change mechanism to thereby form a connection;

two generally vertical members having upper end portions articulatedly connected to said upper member and lower end portions; and a foot support platform articulatedly connected to said lower end portions of said generally vertical members, wherein said direction change mechanisms enable said rectilinear walking movement mechanisms to be moved about respective vertical axes with respect to said pelvis clamp to change the direction of walking, said upper end portions of said generally vertical members being symmetrical with respect to said vertical axis of the movement of said rectilinear movement mechanism with respect to said pelvis clamp.

8. The apparatus of claim 7, wherein said pelvis clamp defines an open rear, said apparatus further comprising:

a locking member for closing said open rear and clamping said pelvis clamp to the wearer's pelvis;

leg clamps respectively mounted on at least one of said vertical members of each of said rectilinear walking movement mechanisms, each of said leg clamps defining a rear opening configured to receive one of the wearer's legs.

9. The apparatus of claim 7, further comprising skids rigidly attached to each of said foot supporting platforms, said skids resting on the walking surface.

10. An apparatus for enabling a disabled wearer to walk on a walk surface, comprising:

a pelvis clamp in the form of a rigid generally elliptical member for securing to the pelvis zone of the wearer;

two movement direction change mechanisms connected to said pelvis clamp, one on each side thereof; and two mechanisms for rectilinear walking movement, one on each side of the pelvis clamp, each of said rectilinear walking movement mechanisms comprising:

an upper member connected to one of said respective movement direction change mechanism to thereby form a connection;

two generally vertical members having upper end portions articulatedly connected to said upper member and lower end portions; and a skid articulatedly connected to said lower end portions of said generally vertical members, wherein said direction change mechanisms enable said rectilinear walking movement mechanisms to be moved about respective vertical axes with respect to said pelvis clamp to change the direction of walking, said connection between each respective of said rectilinear walking movement mechanisms and the direction change mechanisms being generally equidistant said upper end portions of said generally vertical members, and wherein said skids rest on the walk surface.

11. The apparatus of claim 10, wherein said pelvis clamp defines an open rear, said apparatus further comprising:

a locking member for closing said open rear and clamping said pelvis clamp to the wearer's pelvis;

leg clamps respectively mounted on at least one of said vertical members of each of said rectilinear walking movement mechanisms, each of said leg clamps defining a rear opening configured to receive one of the wearer's legs.

12. The apparatus of claim 10, further comprising foot supporting platforms rigidly attached to each of said skids.

* * * * *